US005659288A

United States Patent [19]

Liu

[11] Patent Number: 5,659,288

[45] Date of Patent: Aug. 19, 1997

[54] METHOD FOR SETTING HORN AIR GAP

[75] Inventor: Xiangying S. Liu, Ann Arbor, Mich.

[73] Assignee: Ford Motor Company, Dearborn, Mich.

[21] Appl. No.: 508,809

[22] Filed: Jul. 28, 1995

[51] Int. Cl.[6] ..... G08B 3/00; G10K 9/00

[52] U.S. Cl. ..... 340/388.1; 340/391.1; 116/137 R; 116/142 R

[58] Field of Search ..... 340/388.1, 391.1; 116/142 R, 137 R

[56] References Cited

U.S. PATENT DOCUMENTS

| | | | |
|---|---|---|---|
| 3,516,088 | 6/1970 | Allport | 340/388.1 |
| 3,846,792 | 11/1974 | Haigh | 340/384.73 |
| 4,135,473 | 1/1979 | Frigo | 116/142 R |
| 4,361,952 | 12/1982 | Neese | 116/142 R |
| 4,717,906 | 1/1988 | Smith | 340/391.1 |
| 4,813,123 | 3/1989 | Wilson et al. | 29/593 |
| 5,266,921 | 11/1993 | Wilson | 340/388 |

*Primary Examiner*—Donnie L. Crosland
*Attorney, Agent, or Firm*—David B. Kelley

[57] ABSTRACT

A method for setting the air gap in an automotive horn having an armature and a stud comprises the steps of positioning the stud through an orifice so that it contacts the armature, backing the stud away from the armature a predetermined distance, and fixing the stud to the horn housing so as to establish the air gap between the armature and the stud.

10 Claims, 3 Drawing Sheets

METHOD FOR SETTING HORN AIR GAP

FIELD OF THE INVENTION

The invention relates generally to horns and, more particularly, to a method for setting the air gap between an armature and a stud in an automotive horn.

BACKGROUND OF THE INVENTION

Conventional electronic automotive horns employ an electromagnet which, when energized, produces a magnetic field. The magnetic field induces magnetism in a stud, or pole, which is commonly connected through a horn housing and a diaphragm to an armature, positioned within the coil. The stud, which is also positioned within the coil has a air gap from the armature which, as is known in the art, must be precisely set within predetermined tolerances in order to achieve a sound of desirable quality and frequency.

Various approaches have been taken in setting the appropriate air gap during manufacturing of the horn. One such method, as shown in U.S. Pat. No. 3,846,792 (Haigh) turns a cap which is fitted together with mating cylindrical surfaces to a base, until a diaphragm contacts a core. The cap is then turned in the opposite direction until the contact stops, thus setting an appropriate distance between the diaphragm and the core. In U.S. Pat. No. 4,135,473 (Frigo), an air gap is established by jaws which deform the horn casing thereby moving the core relative to the armature. Such a method, however, requires that the jaws and the casing are appropriately aligned. In addition, the method does not account for machining tolerances.

An adjusting cap is used to establish an air gap in U.S. Pat. No. 4,717,906 (Smith) between an armature and a shank. The cap compresses a housing wall to position the shank with respect to the armature. U.S. Pat. No. 4,361,952 (Neese) discloses a similar air gap adjusting method. Both the Smith and Neese methods require, however, measurement of the horn housing relative to the housing diaphragm mounting surface, which results in additional time, as well as apparatus, and are unsuited for large scale manufacturing operations.

SUMMARY OF THE INVENTION

The present invention provides a method for setting the air gap in an automotive horn which overcomes the drawbacks of the related art. The horn has a housing and a projector with a diaphragm mounted therebetween, an armature attached to the diaphragm extending into a bore formed by windings of an electromagnetic coil, and an orifice in the housing for allowing a stud member to pass therethrough so as to be in alignment with the armature. The stud is first positioned proximate the orifice so as to move in alignment with the armature. Positioning means, such as a hydraulic actuated arm, can be used for aligning the stud. The stud is then moved through the orifice along an axis through the center of the coil toward the armature. When contact is sensed between the stud and the armature, preferably with sensing means such as a load cell attached to the positioning means, movement of the positioning means is stopped. The stud is then moved a predetermined distance away from the armature so as to establish an air gap therebetween. Finally, the stud is attached to the horn housing so as to fix the air gap between the armature and the stud.

An advantage of the present invention is a method which eliminates the need for tight manufacturing tolerances of an automotive horn.

Another advantage is the elimination of tapping operations for allowing the stud to screw into the horn housing.

Still another advantage is an inexpensive and precise method for adjusting an automotive vehicle horn air gap.

BRIEF DESCRIPTION OF THE DRAWINGS

Other objects, features, and advantages of the horn air gap setting method according to the present invention will be apparent to those skilled in the art upon reading the following description with reference to the accompanying drawings in which.

DETAILED DESCRIPTION OF THE PREFERRED EMBODIMENTS

Figure 1:
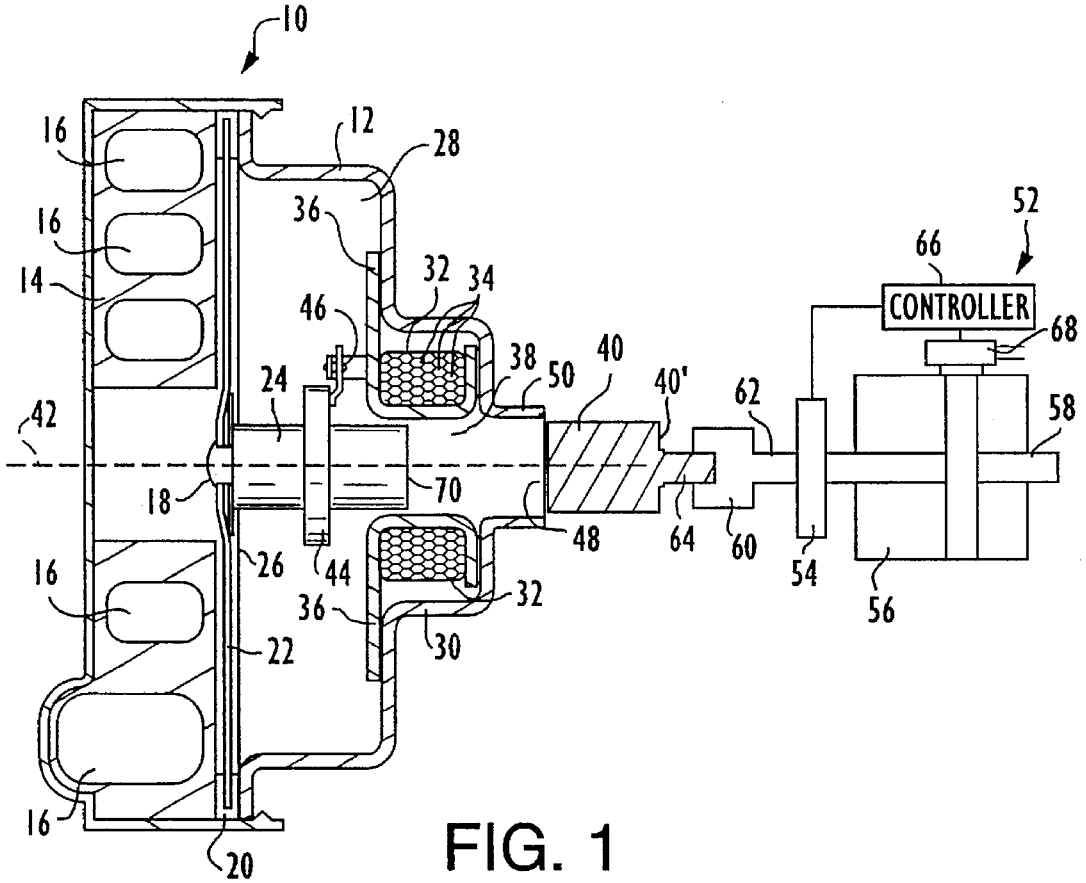
FIG. 1 is a cross-sectional view of an electric horn showing a stud positioned for entry into an aperture by a servo control mechanism as part of a first step according to the method of the present invention.

Referring to the drawings and in particular to FIG. 1 thereof, a cross-sectional view of an electromagnetically operated horn 10 is shown. The horn 10 comprises a housing 12, typically made from sheet metal or anther magnetizable material. On one end 62 of the horn 10, attached to the housing 12, is a projector 14, which preferably comprises a channel 16 winding around a center button 18 culminating in a flared section (not shown). Connected between the projector 14 and the housing 12 is a metallic, flexible diaphragm 22 which, as recognized by those skilled in the art, is vibrated to produce pressure waves which pass through the winding channel 16 and out the flared section of the projector 14, resulting in the characteristic "beep" of the horn 10.

Vibration of the diaphragm 22 is accomplished as follows. A ferro magnetic armature 24 is attached at a center portion 26 of the diaphragm 22 and extends through a center section 28 of the housing 12 into a cup portion 30 of the housing 12. Within the cup portion 30, a coil 32 having generally circular windings 34 is mounted with a bobbin 36. The coil 32, which is connected to an electrical source (not shown) produces a magnetic field therearound when energized, including an area 38 at the center of the coil 32.

Figure 3:
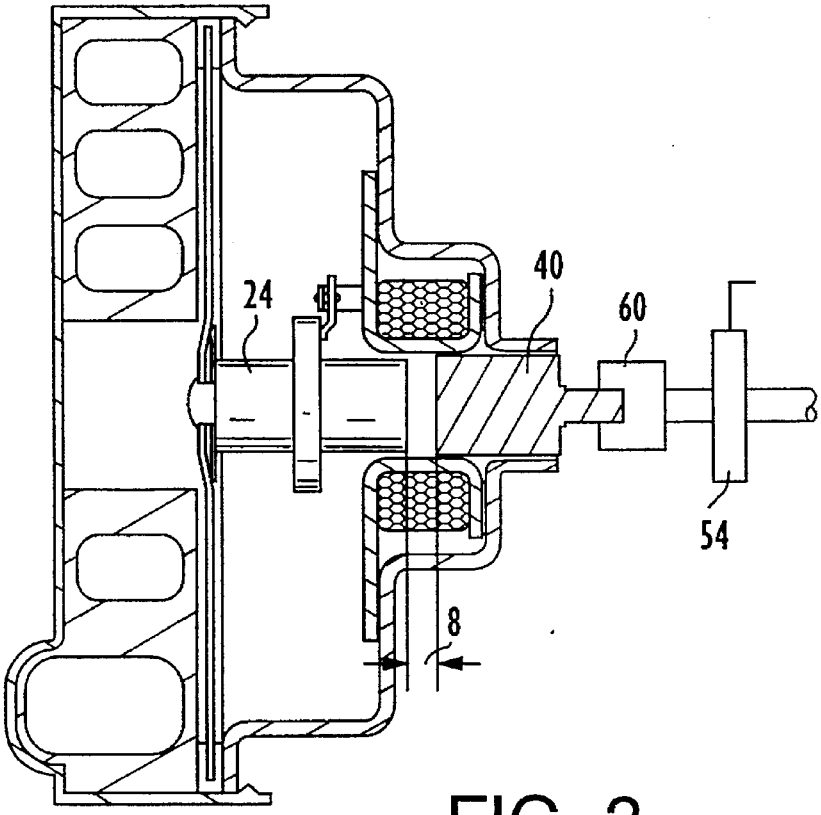
FIG. 3 is a cross-sectional view similar to FIG. 2, but showing the stud positioned at a predetermined air gap from the armature by the positioning mechanism as a step of the method of the present invention.

Still referring to FIG. 1, a stud 40, shown prior to assembly with the horn 10, is placed at a predetermined distance, commonly referred to as an air gap 8 (FIG. 3), from the armature 24, along an axis 42 through the center area 38 of the coil 32. As those skilled in the art will recognize, setting of the air gap 8 is critical to achieving the desired sound output from the horn 10. The distance of the predetermined air gap 8 is important since it will determine, in large part, the sound level and the frequency of vibration of the armature 24, and thus the diaphragm 22, which, as described above, produces the pressure pulsations comprising the sound. To this end, when the coil 32 is energized, the magnetic field thus generated in the center area 38 of the coil 32 results in components of the horn 10 becoming a magnet with one pole being the stud 40, which is ultimately fixed to the housing 12, and the other pole being the armature 24, which also is magnetically connected to the housing 12 through the diaphragm 22. The opposite poles thereby produced will attract, with the result that the armature 24, will overcome the resilient spring force of the diaphragm 22 to move toward the stud 40. As it does so, a cuff 44 on the armature 24 engages a switch 46 which operates to interrupt the electrical current to the coil 32. With the current thus interrupted, the magnetic field ceases and the armature 24 moves back toward its original position, that is, in the direction of the button 18, under the spring force of the diaphragm 22. In so moving, the switch 46 is thus disengaged, allowing current to once again flow into the coil 32 and produce a magnetic field, and the cycle repeats.

With the foregoing description, it can thus be seen that the air gap 8 between the armature 24 and the stud 40 must be precisely set so that the horn 10 produces the desired sound. If the air gap 8 is too high, that is, too much distance between the armature 24 and the stud 40, a lower-than-desired sound output results, thus somewhat defeating the purpose of the horn 10. If the air gap 8 is too small, that is, too little distance between the armature 24 and the stud 40, the armature 24 will strike the stud 40 and create an unpleasant, high-pitched sound which may prove annoying to the operator, and those within earshot. Manufacturing methods, such as the related art described above, do not produce the desired air gap 8 or produce it at extensive cost or assembly time.

The present invention sets the air gap 8 in a horn 10 by positioning the stud 40 a predetermined distance from the armature 24 after the horn 10 components have been assembled. The stud 40 is then fixed relative to the armature 24 so that the air gap 8 is precisely set. As seen in FIG. 1, a horn 10 as described above is assembled except for the stud 40 which is fit through an orifice 48 of a neck portion 50 of the cup portion 30 of the housing 12.

Positioning of the stud 40 is accomplished, as depicted in FIG. 1 via a servovalve-controller combination 52 in conjunction with a load cell 54 and a hydraulic actuator 56. The hydraulic actuator 56 moves an arm 58 to which the load cell 54 is attached for detecting a load transmitted through the arm 58. A claw 60 on an end 62 of the arm 58 grasps a knob 64 extending from an end 62 of the stud 40. Upon a command from a controller 66, the servovalve 68 routes hydraulic fluid to the appropriate side of the hydraulic actuator 56 so as to move the arm 58, and thus the stud 40, through the orifice 48.

Figure 2:
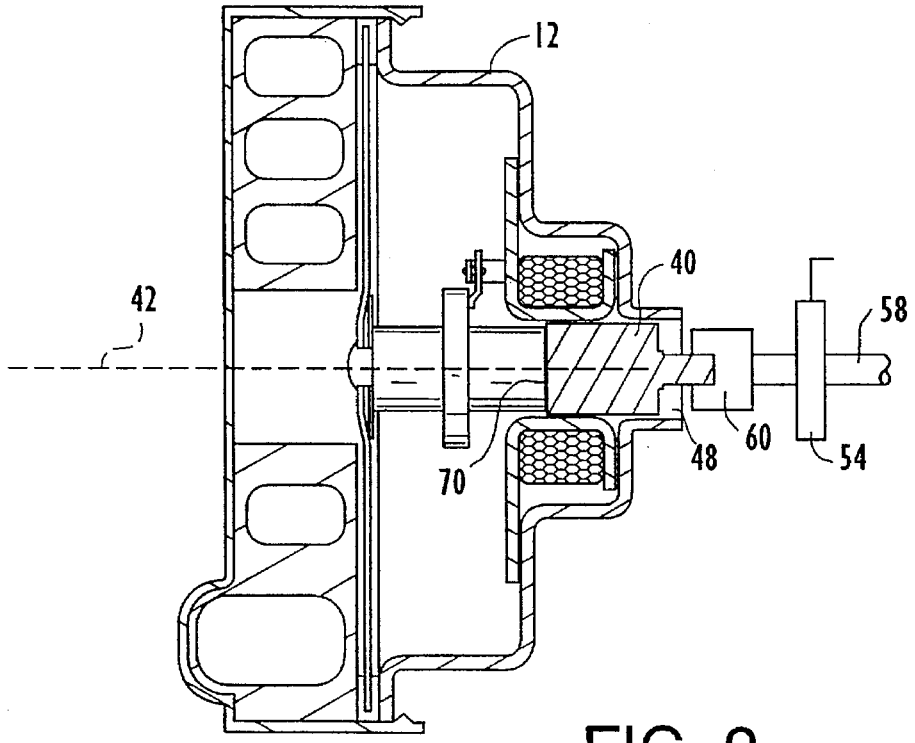
FIG. 2 is a cross-sectional view similar to FIG. 1, but showing the stud inserted through the aperture into the horn in abutting relationship with the armature as a step of the method according to the present invention.

When the stud 40 contacts a face 70 of the armature 24 opposing the stud 40 (FIG. 2) the load cell 54 registers a force which is transmitted to the controller 66. The controller 66 then directs the servovalve 68 to route hydraulic fluid to the hydraulic actuator 56 such that the arm 58 moves in an opposite direction, that is, away from the armature 24, along the axis 42. When the arm 58 has moved the stud 40 a predetermined distance away from the armature 24, so that the appropriate air gap 8 exists between the armature 24 and the stud 40 (FIG. 3), arm 58 movement ceases. That distance can be preprogrammed into the controller 66, as is known.

Figure 4:
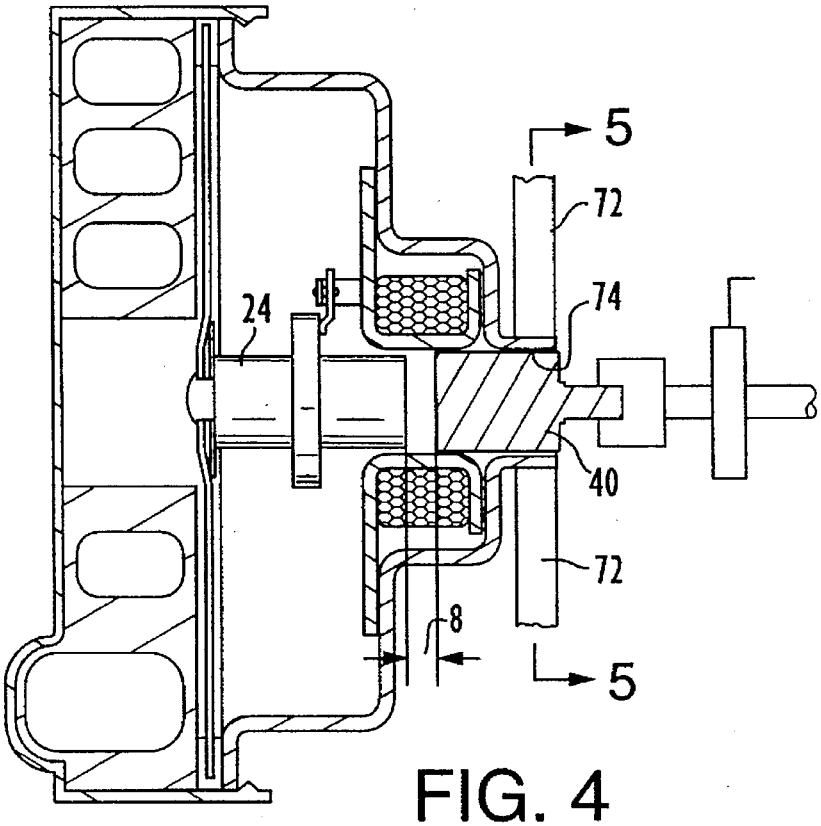
FIG. 4 is a cross-sectional view of a horn similar to FIG. 3 but showing crimping apparatus for crimping the stud neck around the stud so it has to position it within the horn housing.
Figure 5:
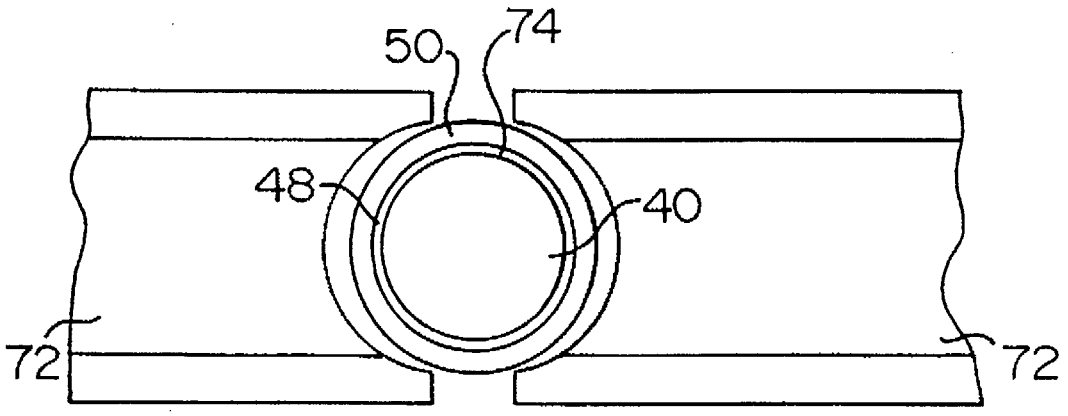
FIG. 5 is a view along line 5—5 of FIG. 4.
Figure 6:
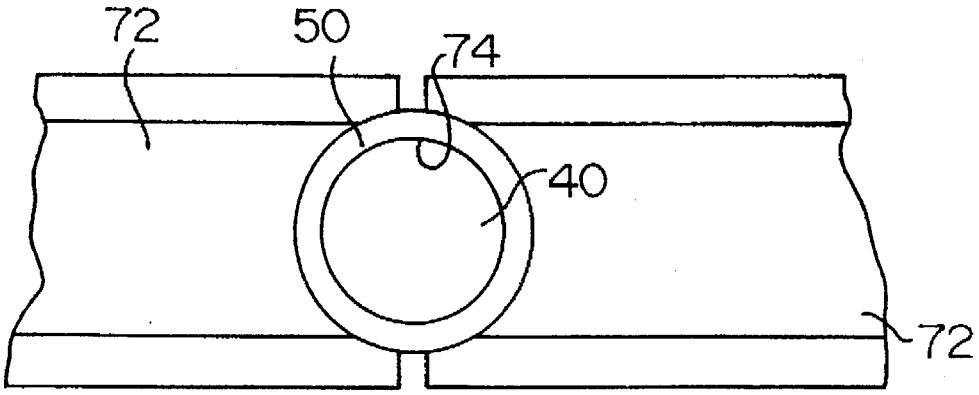
FIG. 6 is a sectional view similar to FIG. 5, but showing the stud neck crimped around the stud so as to hold it in place with respect to the horn.

Upon setting the air gap 8 to the appropriate predetermined distance, a pair of crimping arms 72 depress the stud 50 neck in a direction perpendicular to the axis 42 against an outer surface 74 of the stud 40 so as to hold it in place with respect to the housing 12 (FIGS. 4–6). The stud neck 50 has a larger inner peripheral distance than the outer peripheral distance of the stud 40, as shown in FIG. 5, to allow ease of entry of the stud 40 through the orifice 48. The stud 40 can be a cylindrically shaped, ferro magnetic low carbon metal piece. However, those skilled in the art will recognize that other shapes are possible, such as a solid rectangular shape. Likewise, the armature 24 is made of a ferro magnetic, low carbon metal and is typically cylindrically, or solid rectangularly, shaped.

Preferably, the air gap 8 between the armature 24 and the stud 40 is set at approximately between 0.5 mm., and 1.5 mm., and preferably at 1.0 mm. However, those skilled in the art will recognize that the air gap 8 may vary according to various features of the horn 10, including the size and type of material comprising the armature 24, the stud 40, and, of course, the desired sound output. With the stud 40 and armature 24 made of the materials described above, an air gap 8 of 1.0 mm. will produce a sound output in the range of 400 Hz. to 500 Hz.

The bobbin 36 is preferably made of a plastic piece around which the windings 34 of the coil 32 are wound.

The load cell 54 can be, for example, a piezo-electric transducer, which is calibrated so that a resistance to movement of the arm 58 produces a current which is recognized by the controller 66 as an obstruction. It is important to note that the load cell 54 is capable of being calibrated so as to detect contact between the stud 40 and the armature 24 without deflecting the armature 24 on the diaphragm 22 a significant distance.

The diaphragm 22 is preferably comprised of a ferro magnetic metal and is mounted so as to be capable of springing generally in the direction of the axis 42.

Although the preferred embodiment of the present invention has been disclosed, various changes and modifications may be made without departing from the scope of the invention as set forth in the appended claims.

I claim:

1. In an automotive horn having a housing and a projector with a diaphragm mounted therebetween, an armature attached to the diaphragm extending into a bore formed by windings of an electromagnetic coil, and an orifice in the housing for allowing a stud member to pass therethrough so as to be in alignment with the armature, a method for setting an air gap between the armature and the stud comprising the steps of:

positioning the stud member proximate the orifice;

moving the stud through the orifice toward the armature until contact is made therewith;

moving the stud away from the armature a predetermined distance; and attaching said stuff to said horn so as to be in a fixed relationship the predetermined distance from said armature.

2. A method according to claim 1 wherein the stud is affixed to said horn by crimping a neck flange extending from said horn and defining said orifice to said stud.

3. A method according to claim 1, wherein said predetermined distance is between approximately 0.5 mm. and 1.5mm., and preferably is 1.0 mm.

4. In an automotive horn having a housing and a projector with a diaphragm mounted therebetween, an armature attached to the diaphragm extending into a bore formed by windings of an electromagnetic coil, and an orifice in the housing for allowing a stud member to pass therethrough so as to be in alignment with the armature, a method for setting an air gap between the armature and the stud comprising the steps of:

positioning the stud proximate the orifice so as to move in alignment with the armature, the stud positioned with positioning means for aligning the stud;

moving the stud through the orifice along an axis through the center of the coil toward the armature;

sensing contact between the stud and the armature with sensing means attached to the positioning means;

stopping movement of the positioning means when contact between the armature and the stud is sensed;

moving the stud a predetermined distance away from the armature so as to establish an air gap therebetween; and attaching the stud to the horn housing so as to fix the air gap between the armature and the stud.

5. A method according to claim 4 wherein the stud is affixed to said horn by crimping a neck flange extending from said horn and defining said orifice to said stud.

6. A method according to claim 4, wherein said predetermined distance is between approximately 0.5 mm. and 1.5 mm., and preferably is 1.0 mm.

7. The method according to claim 4, wherein the positioning means comprises an hydraulically actuated arm.

8. The method according to claim 4, wherein the sensing means comprises a load cell attached to the positioning means.

9. In an automotive horn pre-assembled with a housing and a projector having a diaphragm mounted therebetween, a ferro-magnetic armature attached to the diaphragm extending into a bore formed by windings of an electromagnetic coil, and an orifice through a neck portion of the housing for allowing a ferro-magnetic stud to pass therethrough so as to be in alignment with the armature, a method for setting an air gap between the armature and the stud comprising the steps of:

positioning the stud with a hydraulically actuated arm proximate the orifice so as enable movement along an axis through the center of the coil;

moving the stud through the orifice toward the armature;

sensing contact between the stud and the armature with a load cell attached to the hydraulically actuated arm;

stopping movement of the arm when contact between the armature and the stud is sensed;

moving the stud a predetermined distance away from the armature so as to establish an air gap therebetween; and crimping the neck portion of the housing around the stud so as to fix the air gap between the armature and the stud.

10. The method according to claim 9 wherein the load cell is calibrated such that contact between the stud and the armature does not cause significant deflection of the diaphragm.

* * * * *